United States Patent [19]

Bartolomei

[11] 4,162,604

[45] Jul. 31, 1979

[54] PACKAGING MACHINES USING RETRACTILE THERMOPLASTIC FILM

[76] Inventor: Giuseppe Bartolomei, Rua Guanas 63, Sao Paulo, Brazil

[21] Appl. No.: 813,230

[22] Filed: Jul. 6, 1977

[30] Foreign Application Priority Data

Jul. 16, 1976 [BR] Brazil ..... 7604648

[51] Int. Cl.[2] ..... B65B 53/02

[52] U.S. Cl. ..... 53/557; 219/243; 219/400

[58] Field of Search ..... 53/184 S, 187 R, 557; 219/243, 400; 156/497, 515

[56] References Cited

U.S. PATENT DOCUMENTS

| | | | |
|---|---|---|---|
| 3,378,989 | 4/1968 | Denker | 53/184 S |
| 3,399,506 | 9/1968 | Howe | 53/184 S X |
| 3,443,356 | 5/1969 | Hani | 53/184 S |
| 4,104,848 | 8/1978 | Torre | 53/557 |

*Primary Examiner*—Travis S. McGehee

*Attorney, Agent, or Firm*—Robert E. Burns; Emmanuel J. Lobato; Bruce L. Adams

[57] ABSTRACT

In a packaging machine assembly using retractile thermoplastic film the improvement comprises the combination of a conventional sealing apparatus and a shrink tunnel to form a single working unit, said tunnel being comprised of a prismatic chamber or compartment having double walls and intermediate thermal insulation and is formed at the end section of the sealing apparatus itself downward in respect to an L-shaped electrical seal and cut resistance means, said chamber or compartment also comprising a grated top surface and provided with an air circulating means, one or more electrical resistances for heating, a hot air flow regulator, and upper laterally-pivoted lid means having transparent walls for airtight contact with the top working surface of the chamber.

8 Claims, 3 Drawing Figures

PACKAGING MACHINES USING RETRACTILE THERMOPLASTIC FILM

BACKGROUND OF THE INVENTION

As it is well known to the public, a wide range of products, specially foods, such as fruits, vegetables and others are packed, in given quantity and weight, in plastic-film wrappings for sale in supermarkets and the like.

Said plastics wrappings are obtained from retractile or shrinkable thermoplastic films, that is, films which are applied to envelop such products and are capable of shrinking under the action of a heat source, so as to conform to the shape of the products to be packed. The resulting tightly-packed products form a single unit which renders them easier to handling, stocking or transportation.

In order to accomplish the formation of such plastics wrappings or "blisters" around the products, machine assemblies have been used in which two separate units, i.e., a sealing machine and a shrink tunnel are disposed one after the other according to their order in the operation line. In the sealing machine, a continuous longitudinally folded sheet of plastic film is fed from a reel onto a table where a sheet section is led to conform to the shape of the products to be packed, said sheet section enclosing the goods being then sealed and simultaneously cut off. The packed unit is then taken into a shrink tunnel where the shrinkage of the plastics film around the products is promoted by means of a heat source, thus ending the packaging operation.

Although this type of packaging machine assemblies is largely used at present, it has disadvantages in that it calls for the association of two separately constructed units thus envolving high installation and maintenance costs.

In order to overcome the disadvantages arising from the association of two independent machines, I have devised the improvements which are the object of the present invention.

SUMMARY OF THE INVENTION

According to the present invention, all of the components of the above mentioned two units are combined into a single working unit. Such combination is not just a mere juxtaposition of said two units but an advantageous association of said components so as to obtain a single unit which is economical and relatively small as compared with the conventional two units required for the same packaging operation.

Due to the fact that the packaging set of the present invention is very economical and displays efficiency and production rates as high as conventional assemblies, it can be used even by middle-level industries, many of which have not been able to afford the costs of the current packaging assemblies.

BRIEF DESCRIPTION OF THE DRAWINGS

The present invention will now be described in reference to the accompanying drawings, in which.

DESCRIPTION OF THE PREFERRED EMBODIMENT

According to the drawings, the improved packaging machine of the present invention comprising a sealing unit including a table 1 in one of the extremities of which a feeding reel 2 for the plastic film 3 is located, the film being folded longitudinally and directed towards a unit 4 for sealing and cutting the plastic film. This unit is mounted in the opposite extremity of the table and is formed essentially of an L-shaped electrical resistor.

Figure 1:
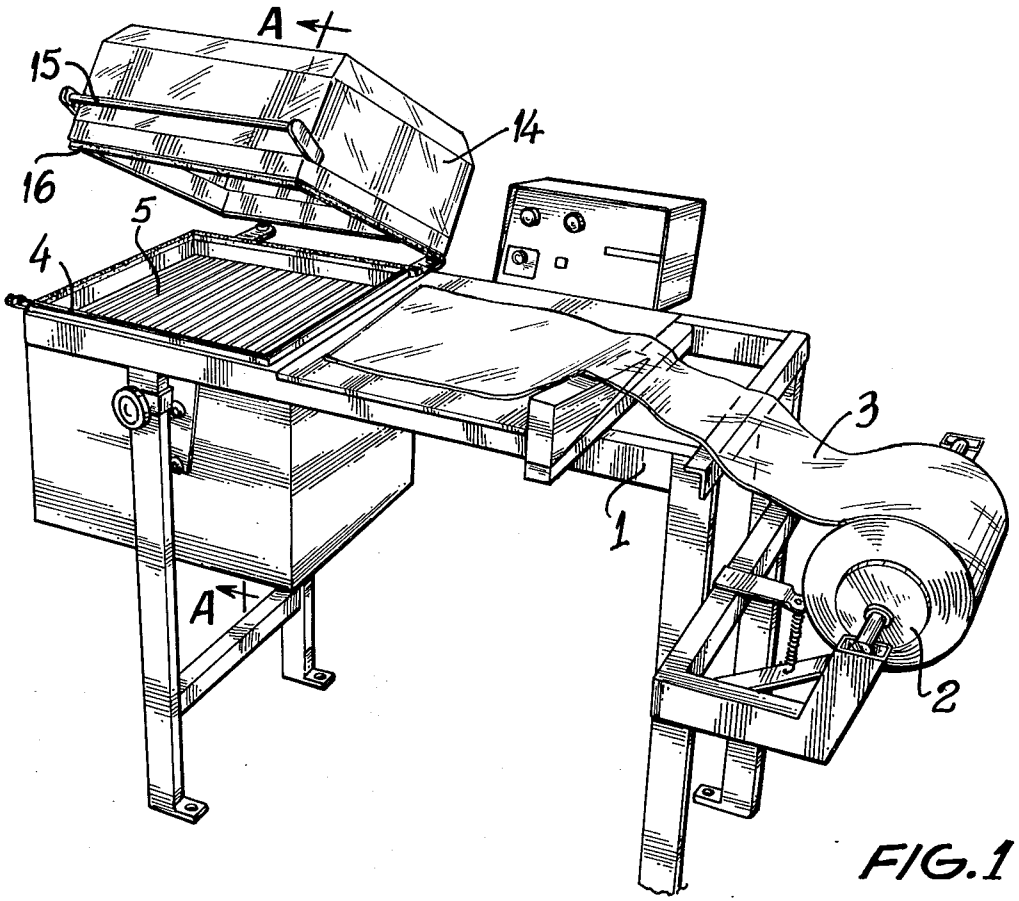
FIG. 1 is a perspective view of the improved packaging machine assembly of the present invention ready for operation.
Figure 2:
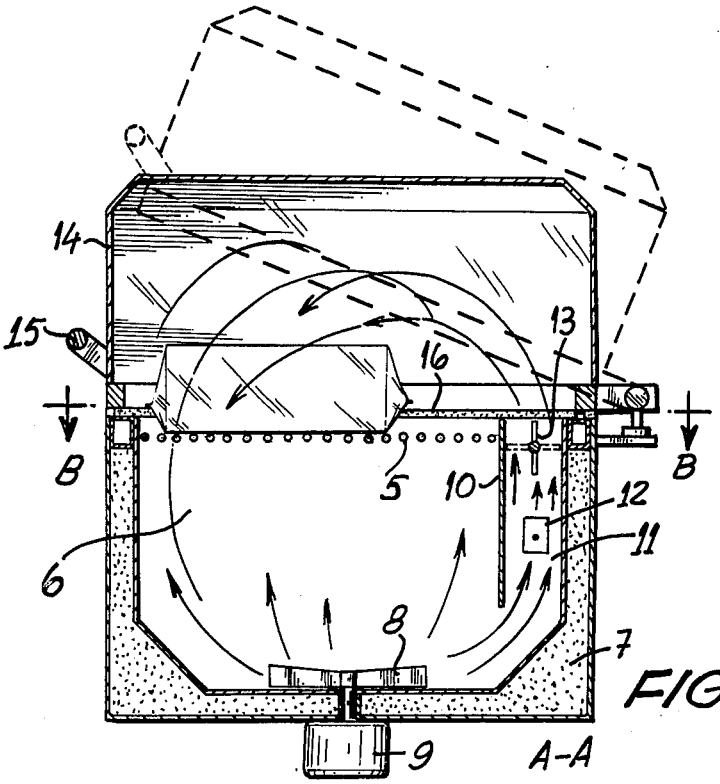
FIG. 2 is a section taken along line A—A in FIG. 1.
Figure 3:
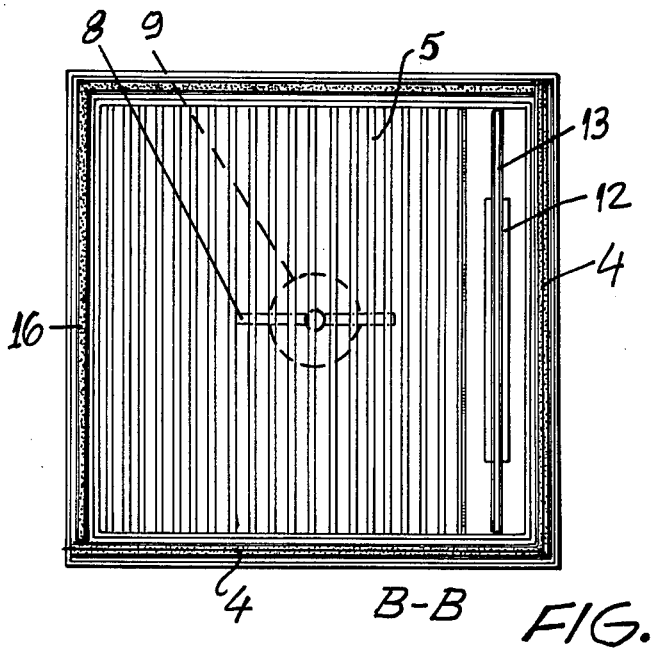
FIG. 3 is a section taken along line B—B in FIG. 2.

According to the present invention the extremity of table 1 of the sealing unit where the seal and cut means 4 is located has a grating 5 of mutually spaced, parallel rods, both shown in FIG. 2, thus providing, as a part of the table, an air-pervious surface; this grating or surface also forming the top section of a compartment or prismatic chamber 6. Chamber 6 has double walls 7, with a thermal isolation therebetween, below this air-pervious table surface. At the bottom section of the chamber there is provided an air circulating device 8 which is actuated by its own motor 9 mounted externally of the chamber.

The interior of chamber 6 is further provided with a vertical cross-sectional dividing wall 10 which extends from one end of grating 5 toward the bottom section of chamber 6 and separates a lateral compartment 11 where one or more electrical resistances 12 for heating are installed. The upper end of compartment 11 is provided with a butterfly damper 13 for air flow control.

In order to close up chamber 6, there is provided a laterally pivoted lid means 14 having transparent walls in line with the walls of chamber 6, as shown. Lid 14 has an external handle 15, this lid being applied for airtight contact with table 1 through the seal and cut means 4 and a complementary flexible L-shaped lid-sealing means 16, comprising strip means extending along two walls of lid 14, one of these walls being disposed opposite to and remote from the feeding reel 2.

The operation of the packaging machine of the present invention starts by pushing the plastic film 3 having its free end already sealed from the previous operation over the seal and cut means 4 and, then, after having placed the product or products to be packed within the longitudinally folded sheet, lowering the pivoted lid 14, so as to promote the sealing and simultaneous separating cutting of the packaging in the same manner as conventional sealers.

After the packaging is sealed, an air circulator 8 and heating resistances 12 are started, either manually or automatically, so that a hot air flow can circulate upwardly through the circulating compartment 11, as shown, and within chamber 6 which is hermetically closed and visible through the transparent lid. The hot air flow causes the desired shrinkage of the plastic film in the packaging making it conform to the configuration of the packed products.

In this manner, and by means of a single operating unit, the performance of conventional assemblies of sealers and shrink tunnels can be accomplished efficiently and economically, in and by the chamber 6, lid 14, and parts thereof.

What is claimed is:

1. A compact heat-shrink packaging machine comprising, a grating; means for supplying longitudinally over the grating an elongate, longitudinally folded plastic, heat-shrinkable film for packaging in lengths of the folded films articles heat-sealed therein; a single unit for sealing successively lengths of the heat-shrinkable film each into a package and shrinking it about articles therein with heat and cutting the film along a seal transverse of the film to sever the sealed package from the film and effect a seal along the leading edge of the film for a next successive length of film to be made into a package with articles therein; said single unit comprising means defining a compartment within which said grating is disposed and having a hinged lid for opening the compartment to allow advancing the film longitudinally and introducing longitudinally a length of said heat-shrinkable film on to said grating and articles in said length of film to be packaged therein and for closing said compartment for heat-sealing and shrinking said length of film; said unit having an electrically energized sealing element having one arm along a side edge of the compartment and over which the length of film is advanced longitudinally and disposed for heat sealing the length of film transversely of the folded film and having another arm along another side edge of the compartment over which an open side of the folded film is advanced for heat sealing along the length of the open side of said length of film to close it; said lid having edges for sealing the compartment closed overlying both arms of said sealing element when the lid is closed for pressing the film overlying said arms of said sealing element and jointly with said sealing element effecting sealing of said length of film into a package and cutting the film along the seals effected; said unit having electrically energized heating elements in said compartment for heating the air therein; driven air-circulating means for circulating air heated by said heating elements through said grating to shrink the length of heat-shrinkable film about the articles therein; whereby in order to make a first package a leading length of said film is first sealed transversely along a leading edge with said one arm and lid and the lid is opened and said length of film is advanced over said grating and sealed with said articles therein and the film is severed from said length while the lid is closed and the leading edge thereof is sealed for insertion of articles into the next successive length of film before advancing it onto the grating.

2. A compact heat-shrink packaging machine according to claim 1, in which said lid has a resilient material lining edges thereof for effecting air-tight closing of the compartment while overlying said sealing element.

3. A compact heat-shrink packaging machine according to claim 2, in which said heating element is L-shaped.

4. A compact heat-shrink packaging system according to claim 1, in which said means defining said compartment defines a compartment below said grating; and in which said lid has transparent walls for viewing the grating and into the compartment.

5. A compact heat-shrink packaging machine according to claim 1, in which said compartment is disposed below the level of said grating and said lid defines said compartment above the level of said grating.

6. A compact heat-shrink packaging machine according to claim 1, in which said means for supplying longitudinally over the grating said elongate, longitudinally folded, plastic, heat-shrinkable film comprises a table surface, alongside said grating; and means mounting a roll of said film at an end of said table surface remote from said grating.

7. A compact heat-shrink packing machine according to claim 1, including a hot air circulator including a dividing wall in said compartment below said grating extending from adjacent the grating toward a lower portion of the compartment to define with another wall of the lower compartment a lateral compartment internally of said lower compartment; the air heating elements being disposed in the lateral compartment.

8. A compact heat-shrink packaging machine according to claim 7, including a butterfly type damper disposed in the lateral compartment above the level of the heating elements.

* * * * *